US006799412B2

(12) United States Patent
Jalbert et al.

(10) Patent No.: US 6,799,412 B2
(45) Date of Patent: Oct. 5, 2004

(54) COTTONER APPARATUS

(75) Inventors: Luc Jalbert, Sainte-Therese (CA); Bruno Jalbert, Vauderuil-Dorion (CA)

(73) Assignee: NJM/CLI Packaging Systems International, Pointe Claire (CA)

( * ) Notice: Subject to any disclaimer, the term of this patent is extended or adjusted under 35 U.S.C. 154(b) by 0 days.

(21) Appl. No.: 10/159,100

(22) Filed: Jun. 3, 2002

(65) Prior Publication Data

US 2003/0221394 A1 Dec. 4, 2003

(51) Int. Cl.[7] ..... B65B 55/00

(52) U.S. Cl. ..... 53/428; 53/115; 53/435; 53/436; 53/474; 493/967; 226/62; 226/67; 226/108; 226/115; 226/158; 225/3; 225/4; 225/14; 225/23; 225/100

(58) Field of Search ..... 53/428, 522, 513, 53/115, 238, 240, 435, 436, 474, 523, 237; 493/967; 226/62, 64, 67, 68, 108, 109, 115, 158; 225/3, 4, 23, 10, 12, 14, 100, 101, 103, 93, 1

(56) References Cited

U.S. PATENT DOCUMENTS

| | | | | | |
|---|---|---|---|---|---|
| 2,412,089 | A | * | 12/1946 | Kelly | 53/435 |
| 2,501,770 | A | | 3/1950 | Gantzer | |
| 2,805,531 | A | | 9/1957 | Dimond | |
| 2,895,273 | A | * | 7/1959 | Lakso | 53/438 |
| 2,895,275 | A | * | 7/1959 | Hollis | 53/506 |
| 3,030,748 | A | * | 4/1962 | Moses | 53/115 |
| 3,137,979 | A | * | 6/1964 | Lakso | 53/115 |
| 3,224,157 | A | * | 12/1965 | Lakso | 53/473 |
| 3,537,228 | A | * | 11/1970 | Cremieux | 53/506 |
| 3,794,228 | A | * | 2/1974 | Colwill et al. | 225/93 |
| 3,987,949 | A | * | 10/1976 | Manning et al. | 225/106 |
| 4,084,391 | A | * | 4/1978 | Williams et al. | 53/120 |
| 4,182,451 | A | * | 1/1980 | Watson | 209/524 |
| 4,454,973 | A | * | 6/1984 | Irvine | 225/100 |
| 4,890,753 | A | * | 1/1990 | Duryee et al. | 215/231 |
| 5,709,066 | A | * | 1/1998 | Prochaska et al. | 53/429 |
| 6,226,081 | B1 | * | 5/2001 | Fantone et al. | 356/239.6 |
| 6,473,170 | B2 | * | 10/2002 | Schafer | 356/240.1 |
| 6,505,457 | B2 | * | 1/2003 | Grass et al. | 53/435 |

* cited by examiner

*Primary Examiner*—Scott A. Smith
*Assistant Examiner*—Gloria R. Weeks

(57) ABSTRACT

A cottoner having a wadding section forming station, the station having: a carrier, a holder, and a feed mechanism mounted on a base in series. Moving means on the base reciprocate the a carrier toward and away from the feed mechanism. An operating controller on the base open and close the holder. The carrier has a gripper for gripping a length of wadding material to carry it from the holding means toward the feeding means when the carrier is moved toward the feed mechanism while the holder is open. The carrier releases the length of wadding material when moved away from the feed mechanism while the holder is closed to hold the length of wadding material.

The cottoner includes an inserting station for inserting each section of wadding material formed at the wadding section forming station into a container.

The cottoner also has a sensing station for sensing if the wadding material has been inserted, and inserted properly, into the container at the inserting station.

The invention is also directed toward a method for operating the wadding station in the cottoner.

20 Claims, 6 Drawing Sheets

COTTONER APPARATUS

BACKGROUND OF THE INVENTION

1. Field of the Invention

This invention is directed toward a cottoner and a method of operating at least part of the cottoner. The invention is more particularly directed toward a cottoner that quickly and cleanly provides sections of wadding material; inserts the sections into containers; and checks that the sections have been properly inserted into the containers. The invention is also particularly directed to a wadding section forming station of the cottoner which provides the sections of wadding material and to a method for operating the section forming station. The invention is further particularly directed toward a sensing station on the cottoner for determining whether or not a container is properly filled with a section of wadding material.

2. Description of the Related Art

Cottoners, providing sections of wadding material which are usually doubled and stuffed into containers holding pills or the like, are well known. The sections of wadding material are usually cut from a long length of the wadding material and fed to a location where the section is doubled and then inserted into the container. The sections are usually cut by cutters such as scissors. However, cutting the wadding material produces loose bits and pieces of the wadding material which bits and pieces can accumulate in the apparatus and eventually interfere with its operation. Frequent cleaning eliminates this problem but is time consuming and not productive. Some cottoners pull the sections off the length of wadding material rather than cutting them off. Examples are shown in U.S. Pat. Nos. 2,501,770 and 2,805,531. These machines are cleaner to operate but they are still quite slow in operation employing, as they do, feed rolls to initially feed the length of wadding material and rotating tables to feed the sections. The known machines are also difficult to thread to start the operations or to continue them if the wadding breaks. The known cottoners also do not sense if the wadding has been properly inserted in the containers. If the wadding sticks out slightly, it may be difficult to place caps on the containers, particularly if the caps are screwed on.

SUMMARY OF THE INVENTION

It is the purpose of the present invention to provide a cottoner apparatus that provides sections of wadding by pulling rather than cutting the wadding thus minimizing the accumulation of the bits and pieces of wadding around the machine during operation. It is another purpose of the present invention to provide a cottoner which is fast, easy to operate, and reliable in operation. It is a further purpose of the present invention to provide a cottoner which can be simply and easily adjusted to provide the sections in different lengths as required. It is another purpose of the present invention to provide a cottoner that can be easily and quickly threaded with the length of wadding to begin operation of the device. It is a further purpose of the present invention to provide a method of operating a wadding section forming station in a cottoner. It is a further purpose of the present invention to provide a cottoner which has sensing means for sensing that the wadding has been properly inserted in the containers, the sensing means located in a position to be readily accessible and adjustable.

In accordance with the present invention there is provided a cottoner having a wadding section forming station for providing sections of wadding which station uses reciprocating carrier means for carrying the length of wadding material to a position where it is sectioned by pulling. The forming station can be easily operated in a slower mode than normal for automatically threading the length of wadding material to start operations. The forming station includes holding means downstream from the carrier means for selectively holding the wadding; and feeding means downstream from the holding means for pulling a section of wadding away from the holding means, the section of wadding separating from the length of wadding at the holding means. The forming station is operated in a sequence where, with the holding means open, the carrier moves toward it to feed the leading end of the wadding material from the holding means to the feeding means. The carrier stops, the feeding means operates and then the holding means closes to have the feeding means pull a section of wadding material away from the length of wadding material at the holding means. The feeding means stops, the carrier moves away from the holding means, the holding means opens, and the cycle is repeated.

The feeding means feeds the separated section of wadding material to a section locating means. From the locating means, a loading station takes the wadding section, folds it and inserts into a container. The filled container is then moved past a sensing station on the apparatus, the sensing station checking that there is a section of wadding in the container and also checking that the wadding is fully within the container and not partially sticking out. The sensing station is in a position where it can be easily adjusted for handling different containers and easily serviced.

The invention is particularly directed toward a wadding section forming station for a cottoner, the station having: carrier means, holding means, and feeding means mounted on a base in series. Moving means on the base reciprocate the carrier means toward and away from the feeding means. Operating means on the base open and close the holding means. The carrier means has gripping means for gripping a length of wadding material to carry it from the holding means toward the feeding means when the carrier means is moved toward the feeding means while the holding means is open. The carrier means releases the length of wadding material when moved away from the feeding means while the holding means is closed to hold the length of wadding material.

The invention is also directed toward a sensing station for a cottoner having a first sensing means for sensing if there is a wadding section in a container and a second sensing means for sensing if the wadding section is fully within the container.

The invention is further directed toward a cottoner apparatus having;

a wadding section forming station for a cottoner, the forming station having: carrier means, holding means, and feeding means mounted on a base in series. Moving means on the base reciprocate the carrier means toward and away from the feeding means. Operating means on the base open and close the holding means. The carrier means has gripping means for gripping a length of wadding material to carry it from the holding means toward the feeding means when the carrier means is moved toward the feeding means while the holding means is open. The carrier means releases the length of wadding material when moved away from the feeding means while the holding means is closed to hold the length of wadding material. The cottoner includes a loading station for taking each wadding section from the forming station and inserting it into a container; and a sensing station having a first sensing means for sensing if there is a wadding section in the container and a second sensing means for sensing if the wadding section is fully within the container.

The invention is also directed toward a method of operating a wadding section forming station in a cottoner to form sections of wadding material from a length of wadding material, the forming station having a carrier means, holding means and feeding means in series. The length of wadding material is passed by the carrier means and has its leading end held by the holding means. The method including the steps of: opening the holding means; moving the carrier means toward the holding means from a first position to a second position, the carrier means carrying the length of wadding material to move the leading end of the wadding material to the feeding means; rapidly operating the feeding means to feed the wadding material past the holding means and the carrier means; operating the holding means to clamp the material when a predetermined amount has been fed past the holding means by the feeding means to separate a section of the material from the length of material at the holding means; and stopping the feeding means after feeding the section through the feeding means.

DESCRIPTION OF THE PREFERRED EMBODIMENTS

Figure 1:
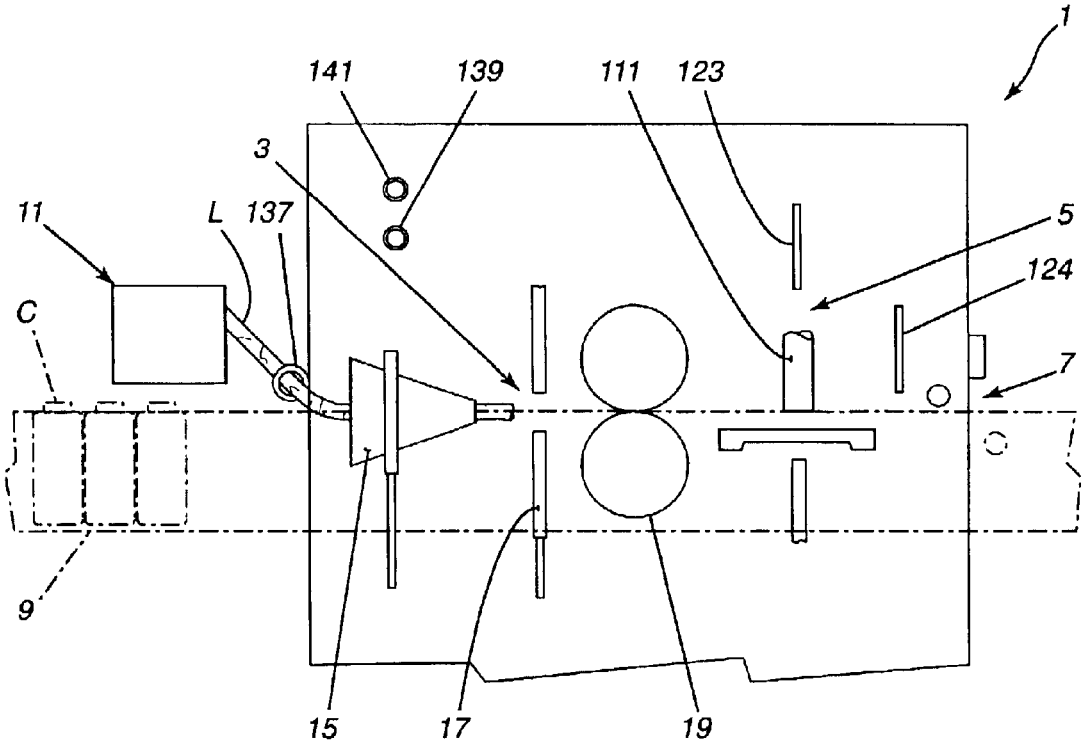
FIG. 1 is a schematic front view of the cottoner apparatus positioned adjacent a conveyor.

The cottoner apparatus 1 of the present invention, as shown in FIG. 1, has a wadding section forming station 3 for forming sections of wadding material; an inserting station 5 next to the forming station 3 for folding and inserting the sections of wadding material into containers; and a sensing station 7 following the inserting station 5 for sensing correct delivery of the sections into the containers. The cottoner apparatus 1 is adapted to be mounted adjacent a conveyor 9 (shown in dotted lines) conveying a line of the containers C (also shown in dotted lines) between a filling station (not shown), where the containers are filled with pills or the like, and a capping station (not shown), where the containers are closed with a cap. A supply 11 of wadding material is located near the apparatus 1, next to the forming station 3. The wadding material is in the form of a long, rope-like length L of material that is coiled to form the supply 11.

Figure 2:
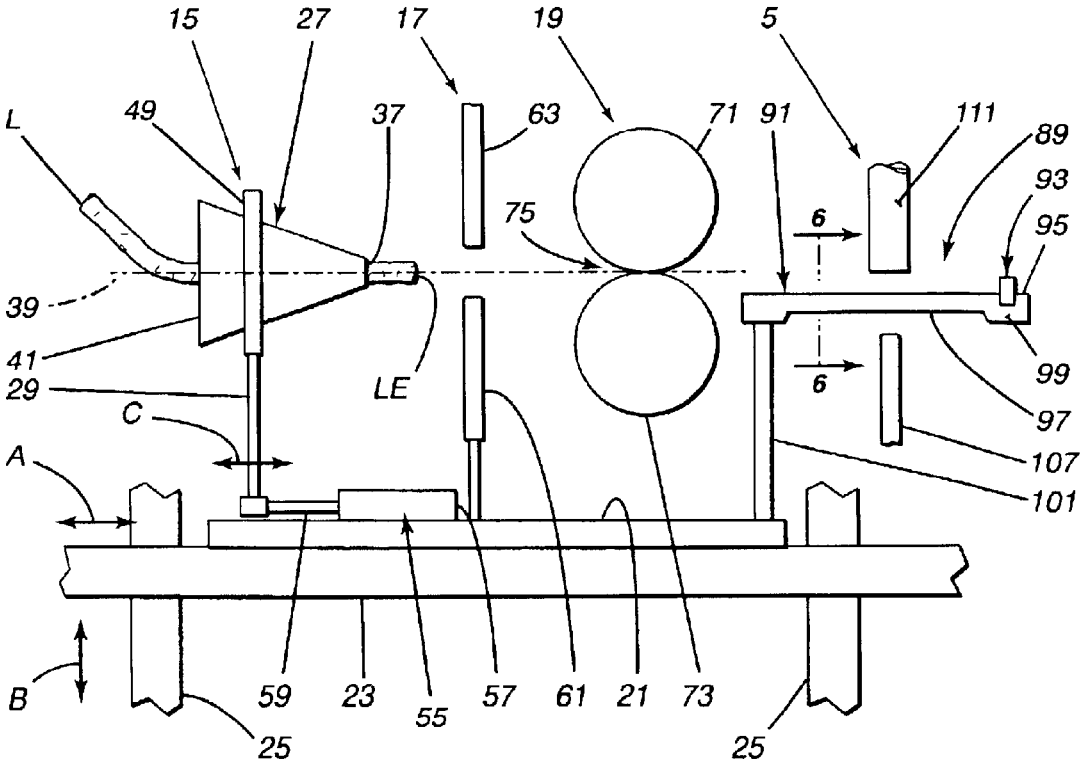
FIG. 2 is a detail, schematic, front view of the cottoner showing the forming station.

In more detail, as shown in FIG. 2, the forming station 3 has carrier means 15, holding means 17 and feeding means 19 arranged serially on a base 21. The base 21 is movably mounted on a sub-frame 23 of the apparatus 1 to be able to move toward or away from the loading station 5 as shown by the arrow 'A'. The sub-frame 23 itself is movably mounted on a main frame 25 to move vertically up or down as shown by the arrow 'B'. The carrier means 15 comprises a carrier 27 mounted on a support 29, the support 29 movably mounted on the base 21 for movement in a direction toward and away from the holding means 17 as shown by the arrow 'C'. The carrier 27 is constructed to hold and move the length L of wadding material toward the feeding means 19 when the carrier is moved toward the holding means 17. The carrier 27 preferably is in the form of a tubular cone with the small end 37 of the cone nearest the holding means 17. The longitudinal axis 39 of the cone is parallel to the direction of movement of the cone. The large end 41 of the cone is farthest from the holding means. The length L of wadding material enters the cone through the large end 41 and emerges from the small end 37. The small end 37 of the cone grips the length L of wadding material as it moves toward the holding means 17.

Figure 3A:
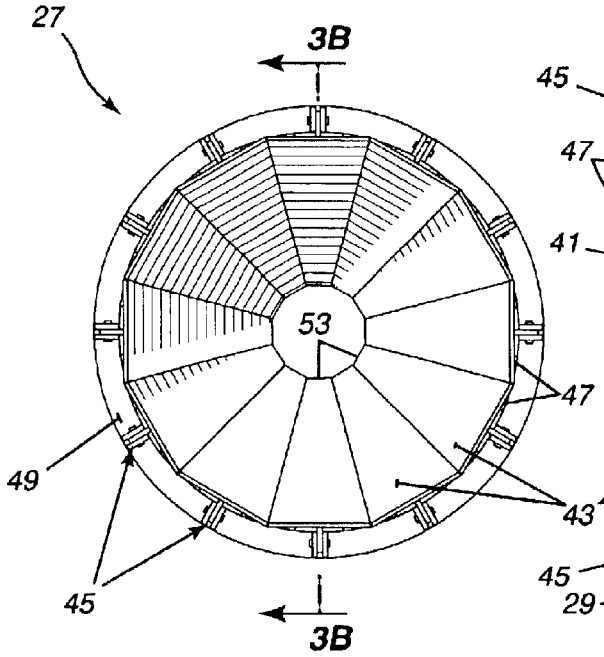
FIG. 3*a* is a rear view of the carrier.
Figure 3B:
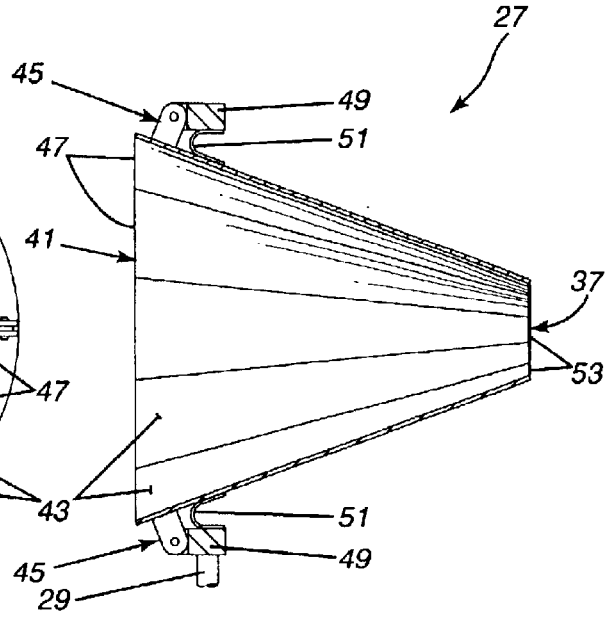
FIG. 3B is a cross-section view of the carrier taken along line 3B—3B in FIG. 3A.

The cone-shaped carrier 27, as shown in FIGS. 3A and 3B, is formed from tapered fingers 43. The fingers 43 are pivotably mounted, by pivots 45, near their large end 47 to a support ring 49. Spring means 51, located between each finger 43 and the ring 49, bias the narrow ends 53 of the fingers 43 together to define the small outlet end 37 of the cone. The narrow ends 53 of the fingers 43 are biased by the spring means 51 to dig into the wadding material as the carrier 27 moves toward the holding means 17.

The ring 49, on which the carrier 27 is mounted, is mounted on the support 29 which in turn is connected to a moving mechanism 55 fixedly mounted on the base 21 as shown in FIG. 2. The moving mechanism 55 can comprise a fluid cylinder 57 having a projecting piston rod 59 with the support 29 connected to the end of the piston rod 59. Operation of the cylinder 57 will move the piston rod 59, and thus the carrier 27, back and forth toward and away from the holding means 17 as shown by the arrow 'C'. The cylinder 57 is parallel to the longitudinal axis 39 of the carrier 27.

Figure 4:
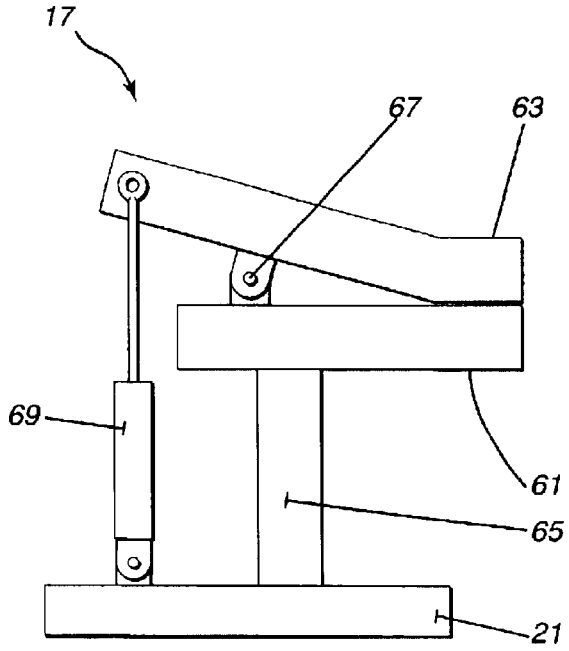
FIG. 4 is a schematic side view showing the holding means.

The holding means 17 are located next to the small end of the carrier 27. The holding means 17, as shown in FIGS. 2 and 4, can comprise a pair of jaws 61, 63 that can be actuated to clamp together, the jaws 61, 63 extending transverse to the direction of movement of the carrier 27. One jaw 61 can be fixed on the base 21, via a support 65, with the other jaw 63 pivoted, via a pivot 67 relative to the one jaw 61. A fluid operated cylinder 69, mounted on the base 21, moves the other jaw 63 with respect to the one jaw 61, about pivot 67 to clamp them together or move them apart.

Figure 5:
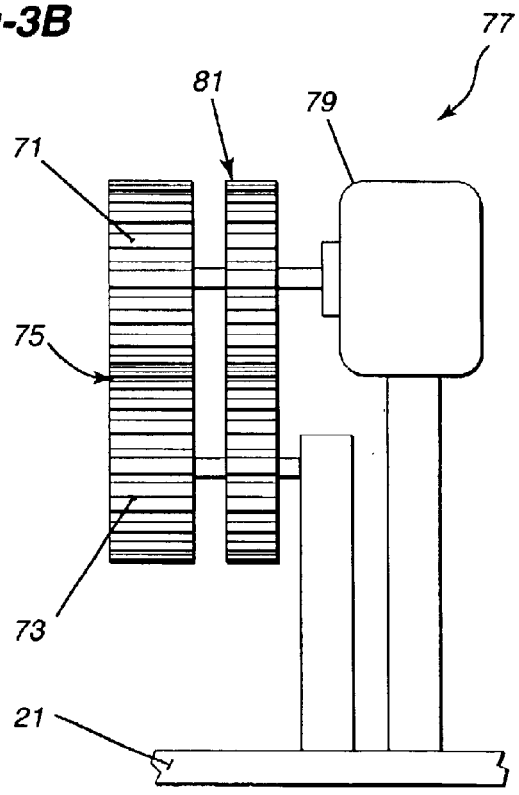
FIG. 5 is a schematic side view showing the feeding means.

The feeding means 19, shown in FIGS. 2 and 5, comprise two feed rolls 71, 73, one above the other, rotatably mounted on the base 21. The feed rolls 71, 73 are adjacent the holding means 17. The axis of rotation of the rolls 71, 73 is transverse to the direction of movement of the carrier 27. The rolls 71, 73 are preferably spring loaded toward each other by suitable means (not shown) and present a nip 75 into which the leading end of the wadding material is fed from the carrier means 15 through the holding means 17.

Figure 6:
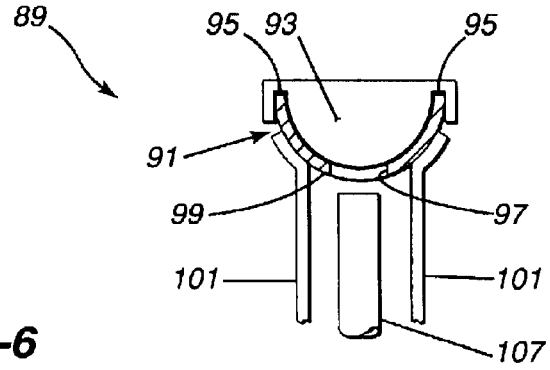
FIG. 6 is a cross-section view taken along line 6—6 in FIG. 2 showing the section locator.

Operating means 77, which could be in the form of a two-speed motor 79, rotates one of the feed rolls 71 and, through gearing 81, the one roll 71 rotates the other roll 73. Other operating means could be employed to rotate the feed rolls The forming station 3 has a wadding section locating means 89 positioned directly behind the feeding means 19. The locating means 89, as shown in FIGS. 2 and 6, preferably comprises an elongate, shallow, tray 91 generally aligned with the nip 75 formed by the rolls 71, 73. The tray 91 receives sections of wadding material fed from the rolls as will be described. A stop 93 is frictionally mounted on the top edges 95 of the tray 91, the stop 93 forming an adjustable end wall for the tray which end wall limits the movement of the sections of material and thus locates them on the tray. An elongated slot 97 is provided in the bottom of the wall 99 of the tray 91 between its ends. The tray 91 is mounted on a support 101 which in turn is mounted on the base 21.

Figure 7:
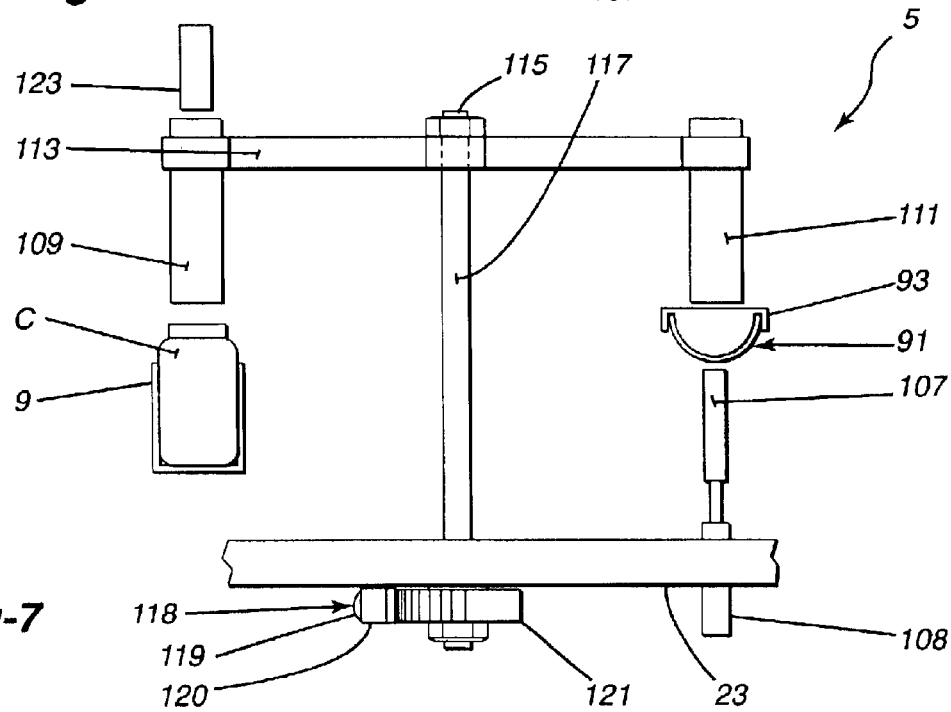
FIG. 7 is a schematic side view of the inserting station.
Figure 8:
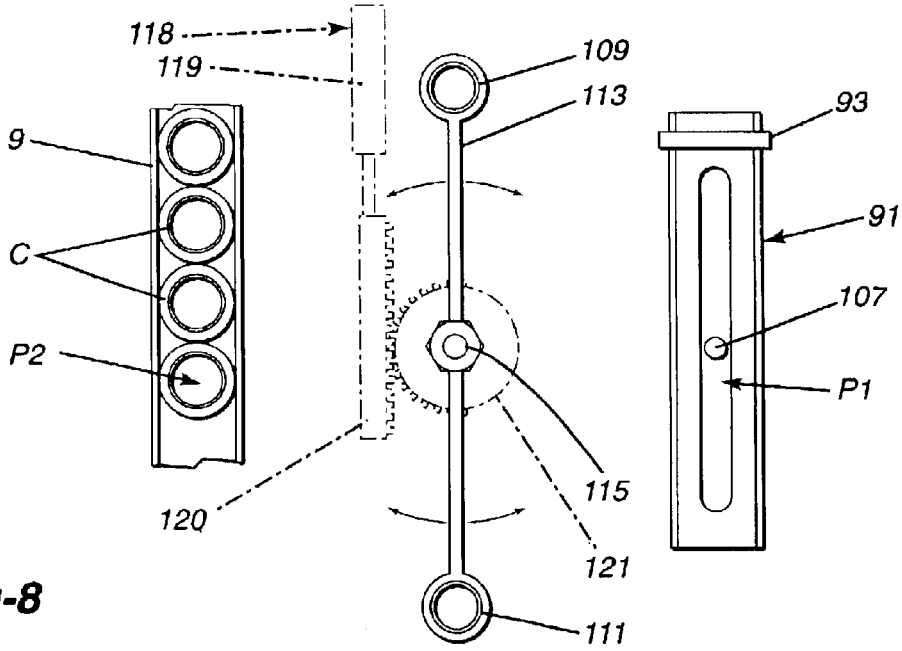
FIG. 8 is schematic top view of the inserting station.
Figure 9A:
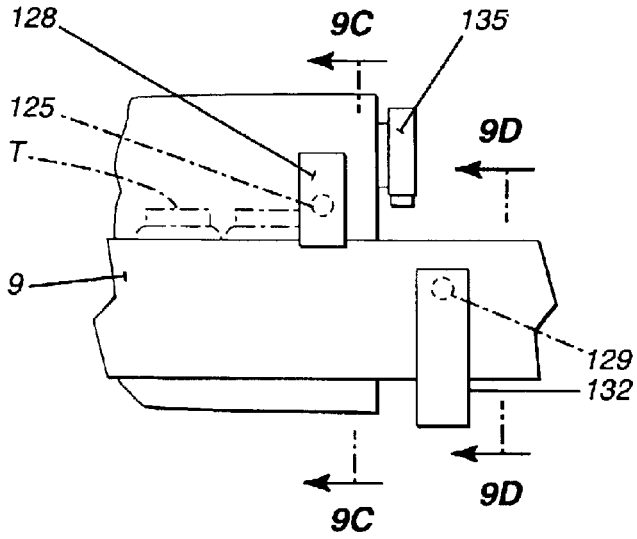
FIG. 9A is a schematic side view of the sensing station.
Figure 9B:
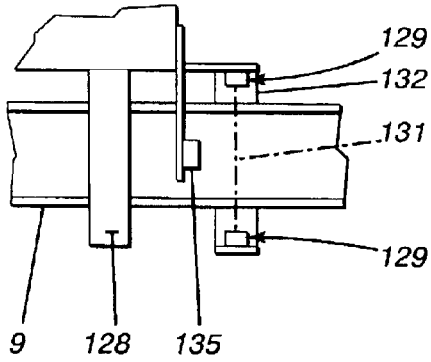
FIG. 9B is a schematic top view of the sensing station.
Figure 9C:
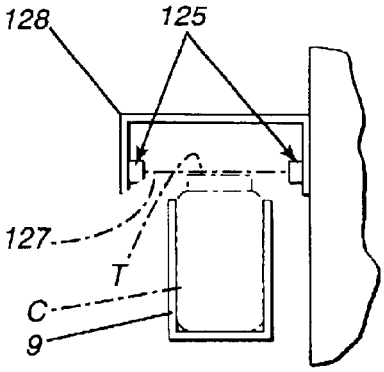
FIG. 9C is a schematic cross-section view of the sensing station taken along line 9C—9C in FIG. 9*a;*
Figure 9D:
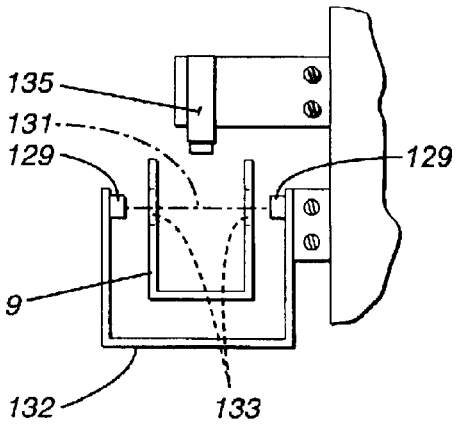
FIG. 9D is a schematic cross-section view of the sensing station taken along line 9D—9D in FIG. 9*a*.

The inserting station 5, adjacent the section forming station 3, takes the sections of wadding material and inserts them into containers on the conveyor. The inserting station 5, as shown in FIGS. 1, 7 and 8, has a folding member 107 provided on the apparatus below the tray 91, the folding member 107 aligned with the slot 97 in the tray allowing the member to move longitudinally relative to the tray if needed. Moving means, such as a pneumatic cylinder 108 mounted on the sub-frame 23 of the machine, move the folding member 107 up and down through the slot 97 in the tray 91. A pair of transport tubes 109, 111 are mounted at the ends of an arm 113 which is mounted, at its center, on a vertical rod 115. The rod 115 passes through a support 117. The support 117 is mounted on the sub-frame 23 of the machine. A pneumatic rotary drive 118 mounted on the sub-frame 23, rotates the rod 115 to rotate the arm 113 back and forth on the support 117. The drive 118 can comprise a pneumatic cylinder 119 moving a rack 120 to rotate a gear 121 fixed on the rod 115. Other drive means can be employed. The transport tubes 109, 111 are cylindrical and are each moved back and forth, by rotation of the arm 113, in a semi-cylindrical arc from a first position P1 over the tray 91 aligned with the folding member 107, and a second position P2 over a container C on the conveyor 9. A pusher member 123 is located above the container C at the second position P2 above the tubes 109, 111. The pusher member 123 is connected to moving means (not shown) mounted on the sub-frame 23 of the machine. The moving means can comprise a pneumatic cylinder. A tamping member 124 is located downstream of the pusher member 123 along the conveyor 9 to complete insertion of the wadding into the container C. The tamping member 124 is also connected to suitable moving means (not shown), such as a pneumatic cylinder, mounted on the sub-frame 23 of the machine. The position of the tamping member 124 can be adjusted longitudinally relative to the position of the pusher member 123.

The sensing station 7 is located adjacent the conveyor 9 downstream from inserting station 5. The sensing station 7 has means for sensing if there is a wadding section in the container C and for sensing if any of the wadding extends out of the container C. A container will be taken off the conveyor if no wadding is sensed, or if wadding material, which would interfere with capping, extends out of the container. The sensing station 7, as shown in FIGS. 9A to 9D, includes a first sensor 125, generating an infrared beam 127, located just above the top T of the containers C being filled with wadding. If the beam 127 is broken by a container passing just under it, the broken beam indicates material sticking out above the top T of the container. The location of the first sensor 125, mounted on a support 128 located on the cottoner just above the conveyor 9, can be adjusted to the height of the containers. A second sensor 129 is located just downstream of the first sensor 125. The second sensor 129 also generates an infrared beam 131 which is located to be broken by the passage of the container C. The second sensor 129 is mounted on a support 132 on the cottoner, the support just under the conveyor 9. The conveyor walls have openings 133 therein for the sensor 129 to sense the leading side of the containers. The breaking of the beam 131 by a container C triggers operation of a light source 135 above the center of the container C. The light source 135 sends a beam of light into the container C and senses its reflection to determine if wadding is in the container.

In operation, the cottoner apparatus 1 is mounted adjacent the conveyor 9 passing filled containers C to a capping station. The height of the sub-frame 23 of the apparatus is adjusted relative to the height of the main frame 25 of the apparatus to locate the bottom of the tubes 109, 111 in the loading station 5 just above the tops of the containers on the conveyor. The length of the wadding section to be formed is determined and a timer is adjusted to determine how long the feed rolls 71, 73 of the feeding means 19 operate and when the jaws 61, 63 of the holding means 17 are closed to get the length of wadding section desired. The length could range from between three inches and eight inches. The base 21 of the forming station 3 is adjusted horizontally on the sub-frame 23 to position the rolls 71, 73 the required distance from the folding member 107 on the base 23 at the loading station 5 to obtain the length of section desired to be formed so that the folding member 107 will be about midway of the section when the section is delivered from the feed rolls 71, 73 to the tray 91. The slot 97 in the tray 91 allows the tray to move horizontally relative to the folding member 107. The end wall 93 on the tray 91 is also adjusted to suit the length of section so as to locate the section about midway relative the folding member 107 when delivered onto the tray.

Figure 10A:
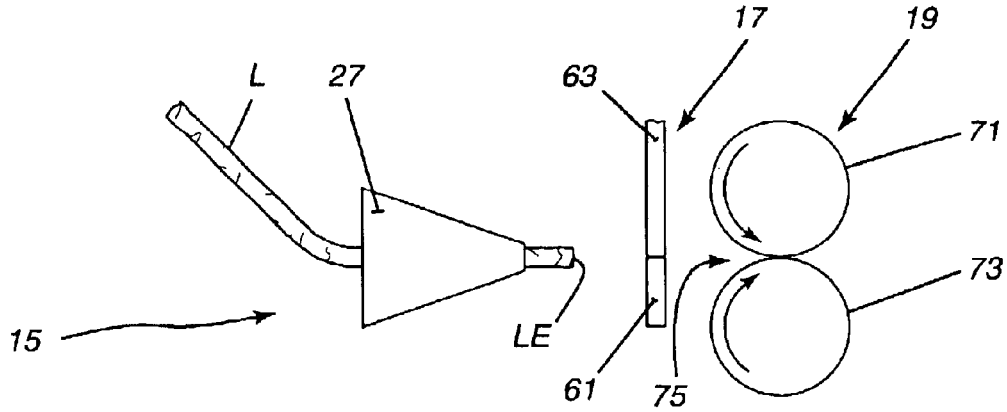
FIGS. 10A to 10F are schematic views showing the operation of the forming station.
Figure 10B:
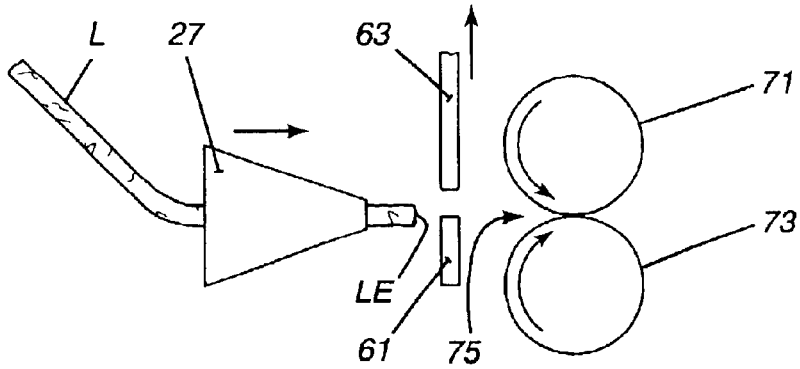
Figure 10C:
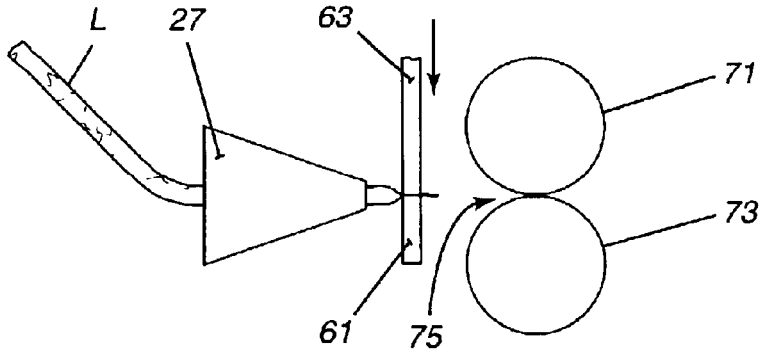
Figure 10D:
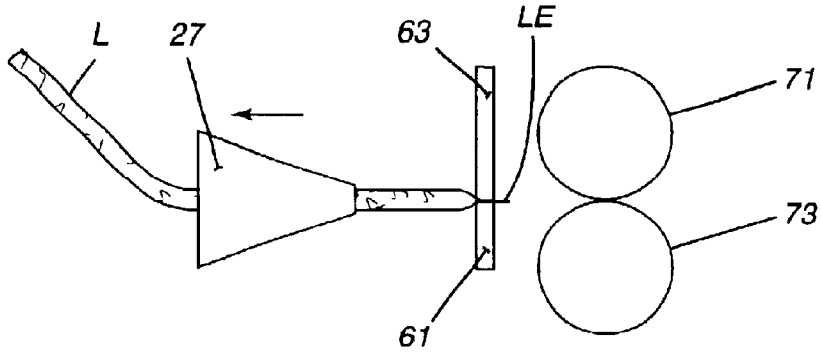

A supply 11 of wadding material is mounted on or adjacent the apparatus and the leading end LE of the length L of wadding is fed by hand through a guide 137 on the apparatus and then through the carrier 27 and out the small, front end 37 so that the leading end LE of the wadding length L projects slightly past the front end 37 of the carrier as shown in FIGS. 1 and 2. A first control 139 on the apparatus is then actuated to operate the apparatus in a first mode of operation. Initially, in this first mode of operation, a threading mode, the feed rolls 71, 73 in the feeding means 19 are stopped, the jaws 61, 63 of the holding means 17 are closed, and the carrier 27, holding the leading end LE of the wadding material, is as far from the holding means 17 as possible, in a first position, as shown in FIG. 10A. Upon actuation of the first control 139, the feed rolls 71, 73 start to slowly rotate, the jaws 61, 63 open, and the carrier 27 is moved toward the holding means 17 to insert the leading end LE of the wadding between the jaws as shown in FIG. 10B. The rolls 71, 73 in this threading mode of operation, would rotate at around 50 rpm. When the carrier 27 reaches its closest, or second, position to the jaws 61, 63, the carrier 27 stops, the jaws 61, 63 close to clamp the wadding as shown in FIG. 10C and the rolls 71, 73 stop rotating. The carrier 27 then moves back to its initial position, sliding over the length L of wadding as shown in FIG. 10D, to complete a threading cycle. The leading end LE may reach the slowly rotating rolls 71, 73 and enter the nip 75 when the carrier is first moved toward the jaws. If this happens, the cycle is completed by having the jaws close, the rolls stop rotating, and the carrier return to its first position. The threading mode is now completed since the wadding material has reached the rolls.

Figure 10E:
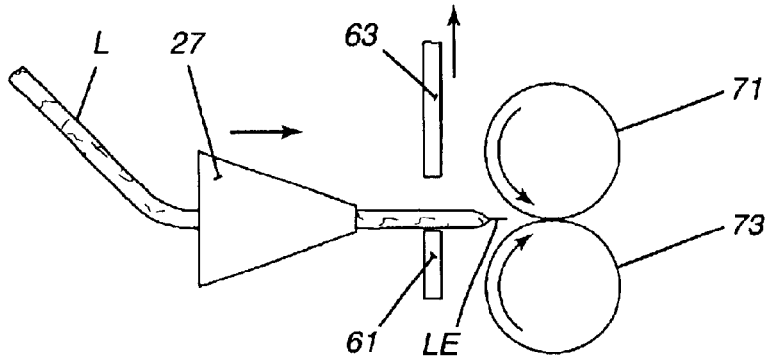

If the wadding is not long enough to reach the rolls, the threading cycle is repeated by again actuating the first control 139 to open the jaws 61, 63; move the carrier 27 toward the jaws and thus move the leading end LE of the wadding from the jaws 61, 63 toward the rolls 71, 73 as shown in FIG. 10E; and slowly rotate the rolls to pick up the leading end of the wadding to complete threading. The threading mode may even require a third cycle of operation to complete threading, each cycle actuated by pressing the first control 139. The number of cycles required depends on the distance the wadding material initially extends from the carrier 27.

Figure 10F:
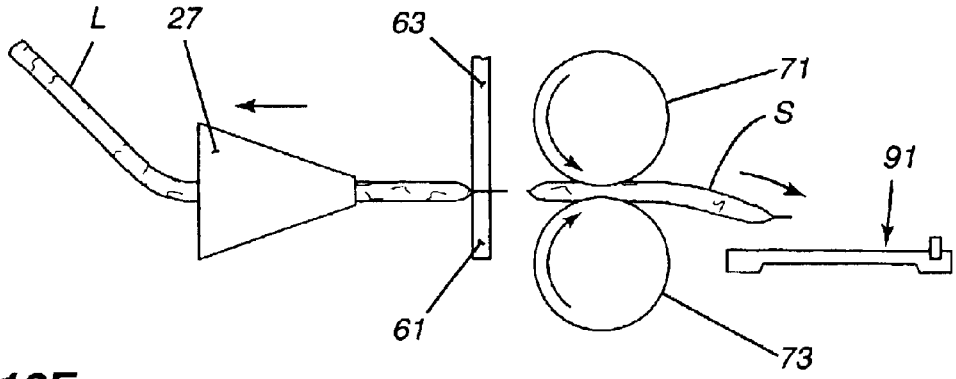

Once threading of the wadding length between the rolls is completed, the machine is put in an automatic production mode operation, filling containers with sections of wadding material, through actuation of a second control 141. When in a production mode of operation, the carrier 27 moves toward the open jaws 61, 63 of the holding means 17 to the second position and the feed rolls 71, 73 are rotated at high speed, around 360 rpm, to pull a required amount of length of wadding material past the open jaws 61, 63 and past the carrier 27. When a required amount of wadding has been pulled past the jaws and carrier, the jaws clamp. The rolls continue pulling the length of wadding to separate a section S of wadding from the remainder of the wadding material at the clamped jaws as shown in FIG. 10F. This separated section S of wadding is fed by the rolls onto the tray 91 against the stop 93 to locate it centrally of the pusher 107. While this is happening, the carrier 27 is returning to its initial position. At its initial position, the jaws 61, 63 open, and the rolls stop rotating. The cycle is automatically repeated when the carrier reaches its initial position. The carrier 27 moves again toward the jaws to feed the material through the jaws to the nip of the rolls. The rolls rotate to pull a section out, the jaws clamp to separate the section and the carrier returns. It will be seen that the carrier continually reciprocates toward and away from the jaws to feed the wadding material to the rolls with the aid of the jaws. The jaws are clamped to allow return of the carrier without pulling the material with it. The jaws are unclamped to allow the carrier to feed the leading end of the material from the jaws to the rolls. The rolls pull the next section off, pulling the required amount of material through the carrier before the jaws clamp to separate the section. The rolls are operated intermittently to pull sections of a predetermined length past the jaws before the jaws clamp to allow the section of desired length to be torn off.

The section S of wadding material is fed from the rollers into the tray 91 against the stop 93 which is located to position the section S midway over the folding member 107. The folding member 107 is then actuated to push the section up into the first tube 109 at position P1, folding the section in half as it does so. The arm 113 is then rotated to move the first tube 109 over the container C at position P2 while the second tube 111 is moved from position P2 to position P1 over the tray 91 ready to receive a second section of wadding. The pusher 123 is now actuated to insert the first wadding section into the container from the first tube 109 while a second section is simultaneously pushed up into the second tube 111. The first container is now moved away from position P2 to the tamper 124, a second container moved into position P2, the tubes rotated and the second section is inserted in the second container at P2 from tube 111 while a third section is pushed up into the first tube 109 at P1. The tamper 124 is pushed down into the first container to tamp the first section into the first container simultaneously with the insertion of the second section by the pusher 123 into the second container. Both the pusher 123 and the tamper 124 are operated simultaneously by double acting pneumatic cylinders.

After tamping, the first container is then moved past the sensing station, past the first sensor 125 to ensure that no wisps of wadding material extend above the container and then past the second sensor 129 that ensures that the container has wadding material therein before it is capped. If no wadding is sensed or if wadding is sensed extending out if the container, the container is taken off the conveyor.

The carrier 27 has been described as a cone shaped member composed of spring-biased fingers. The cone shape makes it easy to initially thread the wadding material through the cone and the resilient fingers makes the carrier easily adaptable to carry different sizes of wadding. The fingers allow the carrier to carry the material in one direction but allow the material to be pulled through the carrier and allow the carrier to move in the opposite direction while the material is held in front of it. However, the carrier can comprise other reciprocating types of carrier means that will grip the wadding at a first position, transport the wadding in one direction to a second position, release the wadding at the second position and return to the first position. An alternate carrier for example could comprise a pair of jaws mounted for reciprocating movement, the jaws clamping the wadding at the first position, carrying it to the second position; releasing the wadding at the second position and returning to the first position to reclamp the wadding length at a new location.

The holding means 17 has been described as having two jaws 61, 63, one jaw 61 fixed, the other jaw 63 pivotable. Both jaws however could be constructed to be movable toward and away from each other.

The feeding means 19 have been described as having a two-speed motor for rotating the rolls 71, 73. Other operating means could be employed.

We claim:

1. A wadding section forming station for a cottoner, the station having: carrier means and feeding means mounted on a base with holding means between the carrier and feeding means; moving means on the base for reciprocating the carrier means toward and away from the feeding means; operating means on the base for opening and closing the holding means, the holding means preventing movement of the wadding material when closed; the carrier means having gripping means for gripping a length of wadding material to carry it from the holding means toward the feeding means when the carrier means is moved toward the feeding means while the holding means is open; the carrier means releasing the length of wadding material when moved away from the feeding means while the holding means is closed to hold the length of wadding material.

2. A forming station as claimed in claim 1 wherein the holding means comprise a pair of clamping jaws, the jaws movable by the operating means between a closed position to hold the length of wadding material and an open position allowing the length of wadding material to be moved by the carrier means.

3. A forming station as claimed in claim 2 wherein the feeding means comprise a pair of feed rolls, and rotating means on the base for selectively rotating the feed rolls to pull wadding material past the carrier means and past the jaws when the jaws are in an open position and to pull a section of wadding material off the length of wadding material when the jaws are moved to a closed position.

4. A forming station as claimed in claim 3 wherein the carrier means is in the shape of cone with the axis of the cone aligned with the direction of movement of the moving means, the small end of the cone closest to the holding means and providing the gripping means for gripping the length of wadding material when the cone moves toward the holding means.

5. A forming station as claimed in claim 4 wherein the cane is formed from a set of tapered fingers, the fingers mounted on a ring support, and spring means biasing the fingers from the support to have their small ends converge to form the small end of the cone.

6. A forming station as claimed in claim 3 including a locating tray following the feeding means, the tray generally aligned with the section of wadding material being fed from the feeding means, the tray receiving the section in a position where it can be centrally folded by separate folding means on the cottoner, the tray adjustable longitudinally relative to the folding means to position the section centrally to the folding means irregardless of its length.

7. A forming station as claimed in claim 6 wherein the tray has an end wall adjustable on the tray relative to the folding means.

8. A forming station as claimed in claim 1 wherein the carrier means is in the shape of cone with the axis of the cone aligned with the direction of movement of the moving means, the small end of the cone closest to the holding means and providing the gripping means for gripping the length of wadding material when the cone moves toward the feeding means.

9. A forming station as claimed in claim 8 wherein the cone is formed from a set of tapered fingers, the fingers mounted on a ring support, and spring means biasing the fingers from the support to have their small ends converge to form the small end of the cone.

10. A cottoner having:

a wadding section forming station for a cottoner, the station having; carrier means, holding means, and feeding means mounted on a base in series; moving means on the base for reciprocating the carrier means toward and away from the feeding means; operating means on the base for opening and closing the holding means; the carrier means having gripping means for gripping a length of wadding material to carry it from the holding means toward the feeding means when the carrier means is moved toward the feeding means while the holding means is open; the carrier means releasing the length of wadding material when waved away from the feeding means while the holding means is closed to hold the length of wadding material.

an inserting station for inserting each section of wadding material formed at the wadding section forming station into a container; and a sensing station for sensing if the wadding material has been inserted, and inserted properly, into the container at the inserting station.

11. A cottoner as claimed in claim 10 wherein the holding means comprise a pair or clamping jaws, the jaws movable by the operating means between a closed position to hold the length of wadding material and an open position allowing the length of wadding material to be moved by the carrier means.

12. A cottoner as claimed in claim 11 wherein the feeding means comprise a pair of feed rolls, and rotating means on the base for selectively rotating the feed rolls to pull wadding material past the carrier means and past the jaws when the jaws are in an open position and to pull a section of wadding material off the length of wadding material when the jaws are moved to a closed position.

13. A cottoner as claimed in claim 10 wherein the carrier means is in the shape of cone with the axis of the cone aligned with the direction of movement of the moving means, the small end of the cone closest to the holding means and providing the gripping means for gripping the length of wadding material when the cone moves toward the feeding means.

14. A cottoner as claimed in claim 13 wherein the cone is formed from a set of tapered fingers, the fingers mounted on a ring support, and spring means biasing the fingers from the support to have their small ends converge to form the small end of the cone.

15. A cottoner as claimed in claim 10 including a locating tray on the section forming station following the feeding means, the tray generally aligned with the section of wadding material being fed through the feeding means, and receiving the section in a position where it can be centrally folded by separate folding means at the inserting station, the tray adjustable longitudinally relative to the folding means to position the section centrally to thin folding means irregardless of the length of the section.

16. A cottoner as claimed in claim 15 wherein the tray has an end wall adjustable on the tray relative to the folding means.

17. A cottoner as claimed in claim 10 wherein the sensing station has a first sensing means for sensing if any wadding material is sticking out of the container and a second sensing means for sensing if the wadding material has been inserted into the container.

18. A method of operating a wadding section forming station in a cottoner to form sections of wadding material from a length of wadding material, the forming station having a carrier means; holding means and feeding means in series, with the wadding material passing by the carrier means and having its leading and held by the holding means, the method including the steps of: opening the holding means; moving the carrier means toward the holding means from a first position to a second position, the carrier means carrying the length of wadding material to move the leading end of the wadding material to the feeding means; rapidly operating the feeding means to feed the wadding material past the holding means and the carrier means; operating the holding means to clamp the material when a predetermined amount has been fed past the holding means by the feeding means to separate a section of the material from the length of material at the holding means; and stopping the feeding means after feeding the section through the feeding means.

19. A method means claimed in claim 18 including the steps of moving the carrier means away from the holding means past the length of material from the second position to the first position after the feeding means has stopped; and then opening the holding means to start to automatically repeat the cycle.

20. A method of operating a wadding section forming means in a cottoner to initially thread a length of wadding material in the forming means, the forming means having a carrier means, a holding means and a feeding means in series, the method comprising the steps of: gripping the leading end of the length of wadding material by the carrier means; opening the holding means; moving the carrier means from a first position to a second position adjacent the holding means to carry the wadding material through the holding means and toward the feeding means; slowly operating the feeding means to pick up the leading end of the material if it has reached the feeding means; stopping the feeding means; closing the holding means to clamp the wadding material; moving the carrier means back from the second position to the first position past the length of wadding material; and repeating the above operation of the carrier means, holding means and feeding means until the leading end of the wadding material is gripped by the feeding means.

* * * * *